US008633864B2

(12) United States Patent
Scarpelli et al.

(10) Patent No.: US 8,633,864 B2
(45) Date of Patent: Jan. 21, 2014

(54) ANTENNA HAVING AN ANTENNA TO RADOME RELATION WHICH MINIMIZES USER LOADING EFFECT

(75) Inventors: Tadd M. Scarpelli, Third Lake, IL (US); Eric L. Krenz, Crystal Lake, IL (US)

(73) Assignee: Motorola Mobility LLC, Libertyville, IL (US)

( * ) Notice: Subject to any disclaimer, the term of this patent is extended or adjusted under 35 U.S.C. 154(b) by 1337 days.

(21) Appl. No.: 10/873,870

(22) Filed: Jun. 21, 2004

(65) Prior Publication Data

US 2005/0280585 A1 Dec. 22, 2005

(51) Int. Cl.
*H01Q 1/42* (2006.01)

(52) U.S. Cl.
USPC ..... 343/872; 343/915

(58) Field of Classification Search
USPC ..... 343/700 MS, 700 R, 701–703, 867–873, 343/880–882, 912–916
See application file for complete search history.

(56) References Cited

U.S. PATENT DOCUMENTS

| | | | | |
|---|---|---|---|---|
| 2,923,007 | A * | 1/1960 | Carpenter | 343/727 |
| 5,923,305 | A | 7/1999 | Sadler et al. | |
| 6,229,487 | B1 | 5/2001 | Sadler et al. | |
| 6,333,714 | B1 * | 12/2001 | Takahashi | 343/700 MS |
| 6,373,438 | B1 * | 4/2002 | Hwang | 343/702 |
| 6,473,043 | B1 * | 10/2002 | Hwang | 343/702 |
| 6,725,070 | B2 * | 4/2004 | Kuroda | 455/575.1 |
| 6,839,032 | B2 * | 1/2005 | Teshirogi et al. | 343/702 |
| 6,906,667 | B1 * | 6/2005 | Poilasne et al. | 343/700 MS |
| 2002/0025827 | A1 * | 2/2002 | Song | 455/550 |
| 2002/0047809 | A1 * | 4/2002 | Ikeda et al. | 343/713 |
| 2002/0089453 | A1 | 7/2002 | Tseng et al. | |
| 2004/0017315 | A1 * | 1/2004 | Fang et al. | 343/700 MS |
| 2004/0080457 | A1 * | 4/2004 | Guo et al. | 343/700 MS |
| 2004/0125018 | A1 * | 7/2004 | Ramasamy et al. | 343/700 MS |
| 2005/0176475 | A1 * | 8/2005 | Sawamura | 455/575.3 |
| 2005/0270238 | A1 | 12/2005 | Jo et al. | |

FOREIGN PATENT DOCUMENTS

| | | | |
|---|---|---|---|
| EP | 1 324 425 | A1 | 7/2003 |
| EP | 1 511 183 | A1 | 3/2005 |
| TW | 404082 | B | 9/2000 |
| TW | 512981 | U | 12/2002 |
| WO | WO 00/67342 | | 11/2000 |
| WO | WO 03/103173 | A1 | 12/2003 |

OTHER PUBLICATIONS

Nathan Ida, Engineering Electromagnetics, Springer2000, pp. 1156-1157 and 1164-1165.*

* cited by examiner

*Primary Examiner* — Wilson Lee

(57) ABSTRACT

An antenna is provided, which is located within an enclosure. The antenna includes one or more arms, where each arm has an electrical length corresponding to an intended frequency band of transmission, and along said length of the arm a source of external loading will have a variable effect. The enclosure includes one or more anticipated points of contact, where a source of external loading will be brought into proximity with said enclosure, and where the one or more arms are constructed and arranged to locate the relatively high impedance areas of the antenna at least a predetermined distance from the one or more anticipated points of interest, and the relatively low impedance areas of the antenna are located more proximate the anticipated points of interest.

18 Claims, 3 Drawing Sheets

ANTENNA HAVING AN ANTENNA TO RADOME RELATION WHICH MINIMIZES USER LOADING EFFECT

FIELD OF THE INVENTION

The present invention relates in general to an antenna for use with a wireless communication device. More particularly, the present invention relates to an antenna for use in an enclosure, which includes one or more arms, having an electrical length corresponding to an intended frequency band of transmission, where along said length a source of external loading will have a variable effect, where areas of high and low impedance are selectively positioned relative to one or more anticipated points of contact, where a source of external loading will be brought into proximity with the enclosure.

BACKGROUND OF THE INVENTION

Many factors affect the performance of an antenna including the antenna's own physical dimensions, the proximity of other items including other components of the phone, as well as external elements, such as a user's hand or head. To the extent that the proximally located elements are fixed and known, such as other internal components whose position relative to the antenna does not change, the design can be adjusted to accommodate the other devices. However the more variable elements such as a user's hand are a little more problematic, in so far as their effects may only be selectively present, as well as in a more varied amount.

However, the present inventors have recognized that despite the effects of some nearby elements, which can have a variable effect on the functioning of the antenna, the potential effects can be mitigated by providing a minimum gap between the antenna and the one or more points along the exterior surface of the enclosure that a source of external loading is likely to contact. The effects can be further mitigated by managing the specific portion of the antenna which will come into closest proximity to the anticipated point of approach of the outside influence, where some portions of the antenna may be more or less susceptible to the loading effects from the external source.

The various design considerations can be even more challenging to the extent that the antenna is used in a device where there is a desire to shrink the overall dimensions of the device, and correspondingly the enclosure in which the antenna is located. In many instances the potential effects include one or more various tradeoffs that can affect antenna performance in both positive and simultaneously negative ways, which must be considered.

Consequently by managing the particular portion of an antenna that is more predominately exposed to a source of external loading, the amount of gap between the edge of the enclosure and the antenna can be beneficially adjusted, as well as the overall performance of the antenna.

BRIEF DESCRIPTION OF THE FIGURES

The present invention will be described by way of exemplary embodiments, but not limitations, illustrated in the accompanying drawings in which like references denote similar elements, and in which.

DETAILED DESCRIPTION

As required, detailed embodiments of the present invention are disclosed herein, however, it is to be understood that the disclosed embodiments are merely exemplary of the invention, which can be embodied in various forms. Therefore, specific structural and functional details disclosed herein are not to be interpreted as limiting, but merely serve as a basis for the claims and as a representative basis for teaching one skilled in the art to variously employ the present invention in virtually any appropriately detailed structure. Further, the terms and phrases used herein are not intended to be limiting, but rather, to provide an understandable description of the invention.

Figure 1:
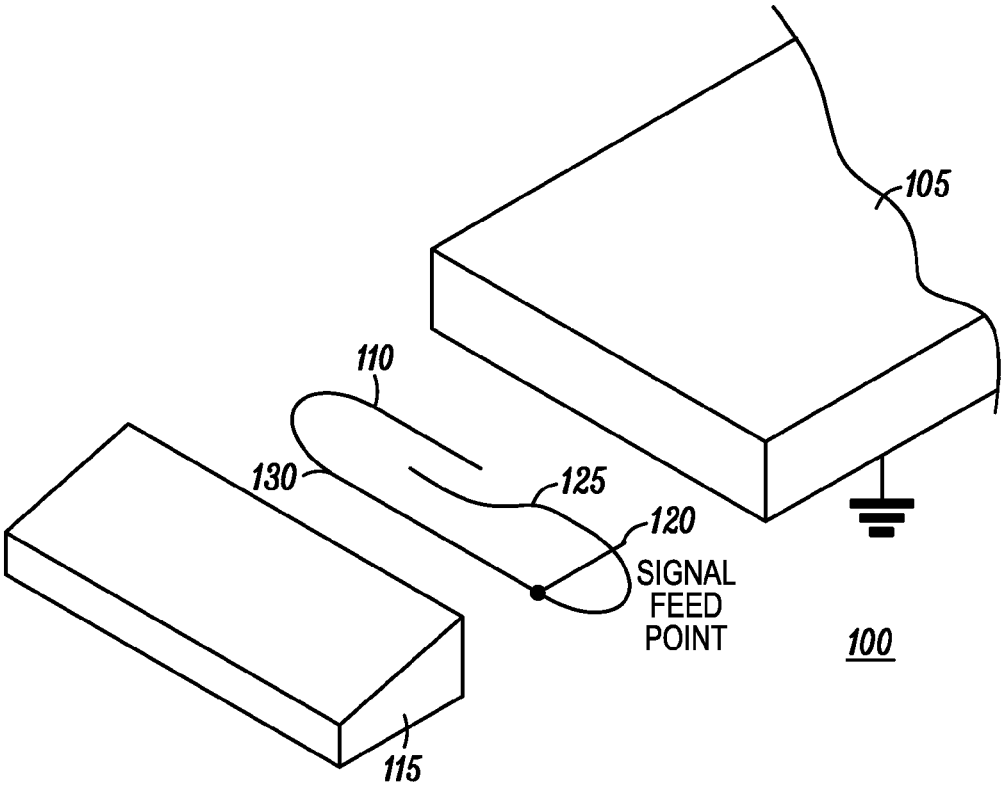
FIG. 1 is a partial perspective exploded view of a handheld communication device including an antenna, in accordance with at least one embodiment of the present invention.

FIG. 1 is a partial perspective exploded view of a handheld communication device 100, such as a cellular telephone, including a ground structure 105 representative of the main body of the handheld communication device 100, an antenna 110, and a radome 115. The antenna 110 includes a signal feed point 120 for receiving signals to be transmitted via the antenna 110, and/or conveying wireless signals detected by the antenna to a reciever (not shown). From the feed point 120, the antenna 110 extends in two directions via a pair of arms. The shorter 125 of the two arms is adapted for transmitting and/or receiving a higher frequency, i.e. shorter wavelength signal. The longer 130 of the two arms is adapted for transmitting and/or receiving a lower frequency, i.e. longer wavelength signal. In the illustrated embodiment, the antenna represents a dual-arm, dual-band monopole antenna, which is driven against the ground structure 105, where the length of each arm generally corresponds to a quarter of the wavelength of the signal frequencies, which the antenna is designed to detect.

The radome 115 forms an enclosure within which the antenna 110 resides. The radome 115, to a limited extent, prevents external originating bodies from encroaching upon the antenna 110. However the encroachment prevention is largely limited only to the external dimensions of the radome 115. In at least one embodiment the radome is formed from a generally non-conductive plastic. In fact, it is generally anticipated that a user's hand will grip the handheld communication device 100 up to or proximate the limits of the radome 115.

Figure 4:
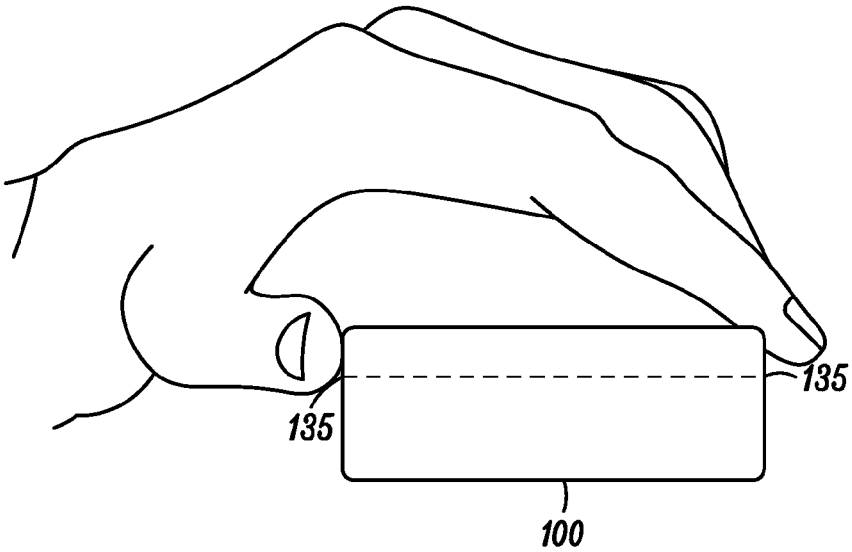
FIG. 4 is a top end view of the handheld device being held by one's hand.
Figure 2:
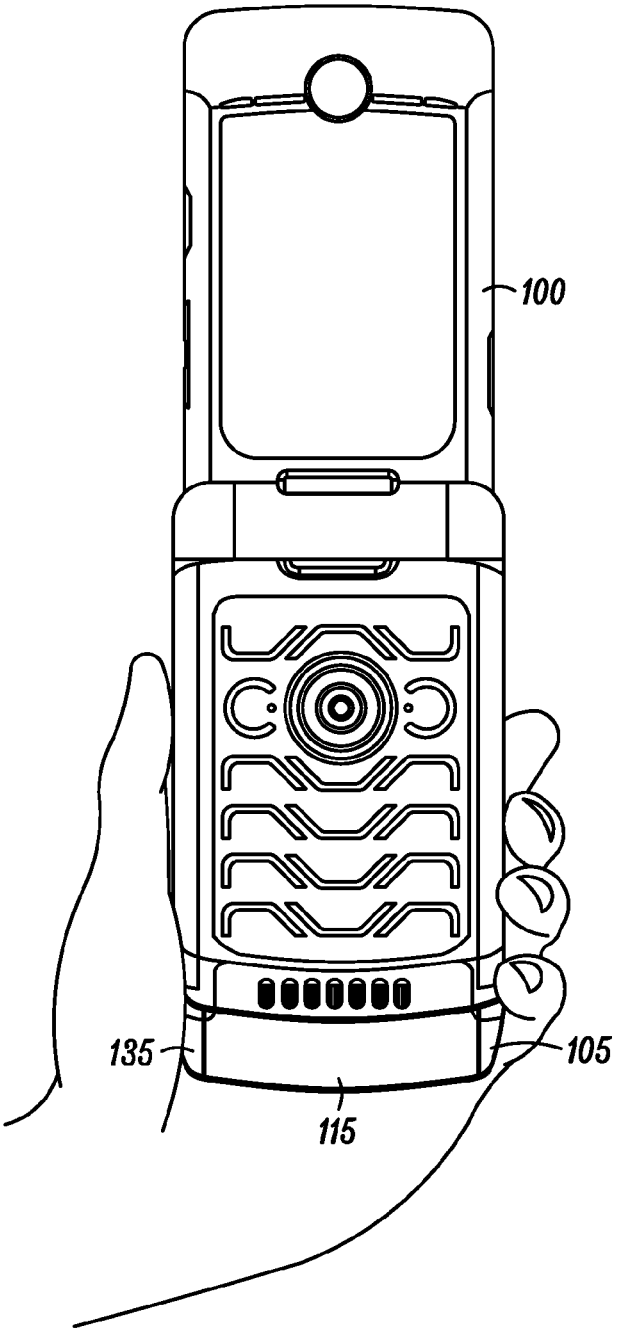
FIG. 2 is a front view of the handheld communication device being held by one's hand.
Figure 3:
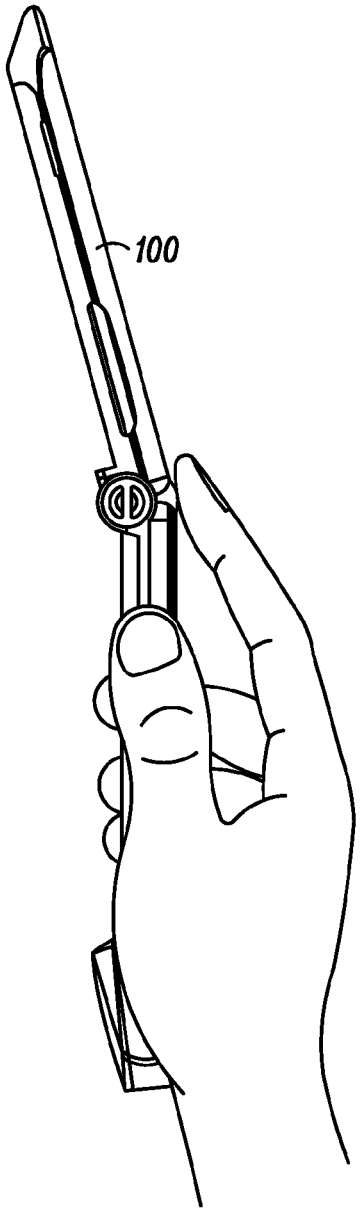
FIG. 3 is a right side view of the handheld communication device being held by one's hand.

FIGS. 2-4 illustrate several different view of a user's hand holding a handheld communication device 100, in accordance with at least one embodiment of the present invention. More specifically, FIG. 2 illustrates a front view of the handheld communication device being held by one's hand, FIG. 3 illustrates a right side view of the handheld communication device being held by one's hand, and FIG. 4 illustrates a top end view of the handheld device being held by one's hand.

FIGS. 2-4, generally illustrate how one would expect a user to hold the handheld communication device 100, while operating the same. In each of the FIGS. it can generally be seen that it can be anticipated that a user operating the device will generally hold the device via the side edges 135 of the device 100. Cupping of the hand tends to pull the rest of the hand away from the back of the device 100. This can be more readily seen in FIGS. 3 and 4.

While the radome 115 to some extent will limit the encroachment of one's hand relative to the antenna 110, given the handheld device's limited overall dimension, some encroachment may be unavoidable. An externally originating body, such as a hand can often provide an electrically coupled source of impedance, which can detrimentally affect the tuning and/or efficiencies of the antenna. Depending upon where the hand or interfering body approaches the antenna, the amount of loading can be affected a varying amount. The amount of the affect can be dependent upon the distance between the interfering body and the antenna, which generally corresponds to the gap between the antenna 110 and the radome 115, as well as the position along the length of the arm of the antenna 110. At different distances along the length of the arm, a standing wave will produce an amplitude of varying intensities.

For a quarter wave antenna the lowest amplitude or lowest impedance is generally seen at the source. The highest amplitude or highest impedance is generally seen at the end of the arm. As a result, an interfering body will often have the greatest affect proximate the end of the arm of a particular antenna. Still further the degree to which the interfering body will affect the particular antenna is often dependent upon the overall length of the antenna, and hence the frequency of signals the antenna is designed to detect. In at least the illustrated embodiment, the higher frequency arms tend to be more susceptible to proximate interfering bodies. Another area of concern includes the area of overlap 140 associated with multiple adjacent arms. In the illustrated embodiment, not only is the area of overlap 140 associated with the end points of a quarter wavelength antenna, but the area of overlap 140 is often specifically tuned to produce beneficial results, in one or more of the arms. Because the overlap area 140 may be especially susceptible, the overlap area is often situated toward the front facing of the handheld communication device, where the hand will not typically be present, or in other words away from the back facing of the phone.

Figure 6:
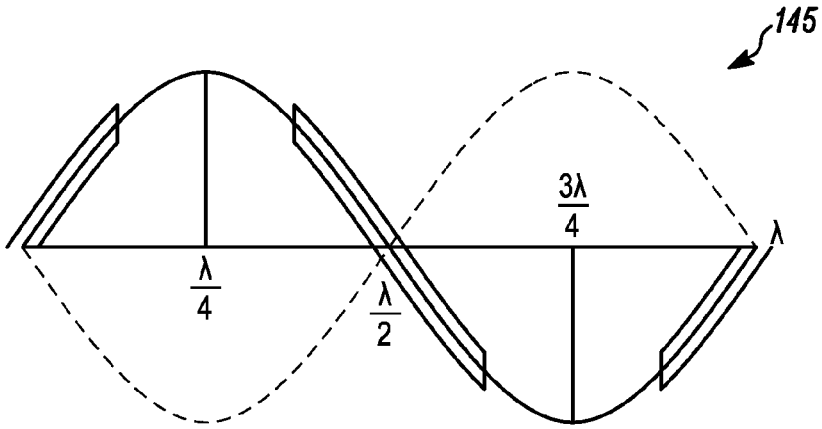
FIG. 6 is a graph of a standing wave having a wavelength of lambda.

FIG. 6 illustrates an example of a standing wave 145, wherein the corresponding amplitude at any distance along the wavelength between zero and lambda, anticipates the degree of susceptibility of the antenna to a nearby interfering body. It is noted that the illustration shows the amplitude beyond the quarter wavelength. While the present invention has been largely described in connection with quarter wavelength antennas, the beneficial teachings of the present invention are believed to also be applicable to other antennas, which correspond to other than quarter wavelength antennas.

Figure 5:
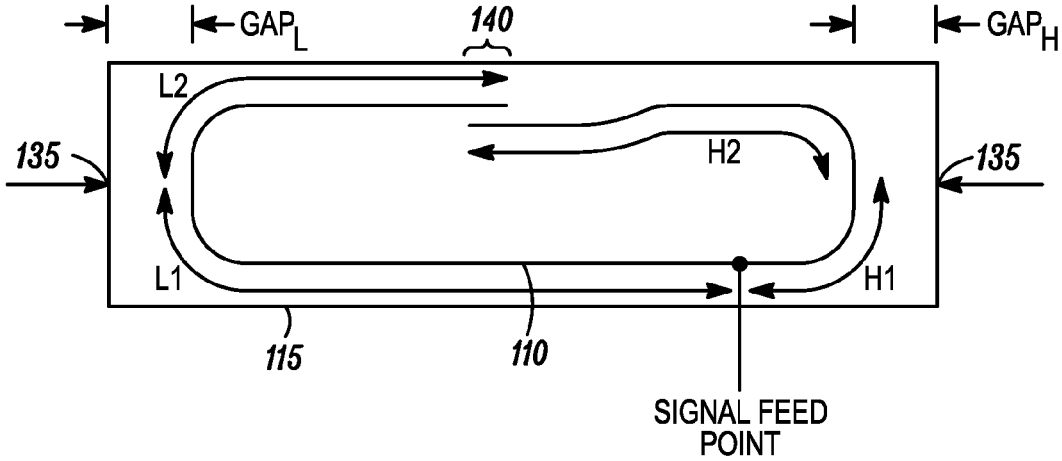
FIG. 5 is a cross sectional bottom end view of the handheld communication device illustrating an antenna within an enclosure at the end of the housing of the communication device, in accordance with at least one embodiment of the present invention.

In the illustrated embodiment, the heavy line may correspond to points along the antenna, which might be largely immune to an approaching interfering body given the size of the gap between the anticipated point of contact and the antenna 110 within the radome 115. By adjusting the point along the antenna 110 at which the antenna arm is closest to the anticipated point of contact 135, one may be able to more effectively manage the effects of the interfering body, and in some instances may even be able to comfortably reduce the gap. In the embodiment illustrated in FIG. 5, the point at which the antenna is closest to the anticipated point of contact 135 can be defined by the ratio of L1 to L2, or H1 to H2. Generally the lower the ratio, the less that a proximately located interfering body will affect the antenna arm.

Figure 7:
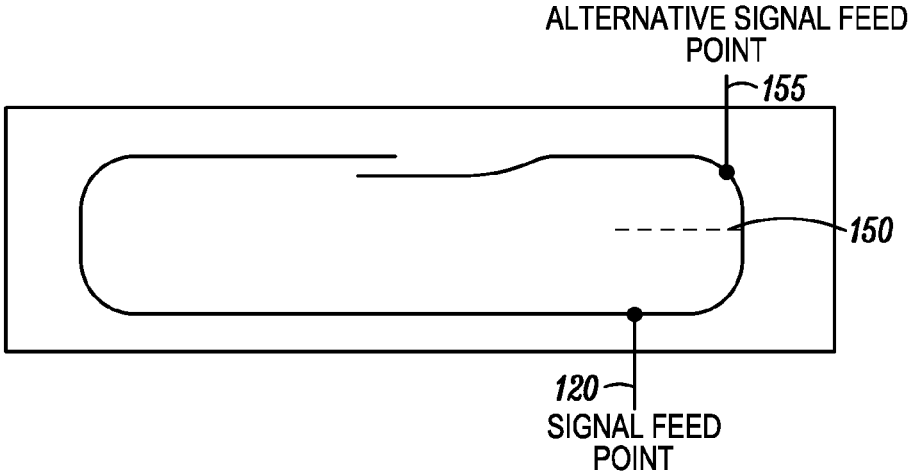
FIG. 7 is a cross sectional bottom end view of the handheld communication device illustrating an antenna in accordance with at least one or more further embodiment of the present invention.

FIG. 7 illustrates a cross sectional bottom end view of the handheld communication device illustrating an antenna in accordance with at least one or more further embodiment of the present invention. In accordance with at least one further embodiment FIG. 7 illustrates the possibility of more than two arms, where a third potential arm, which could be adapted for receiving signals at yet a still further band of frequencies, is illustrated with a dashed line 150. As illustrated, it is possible for the multiple arms to share corresponding lengths of the antenna structure. Furthermore, while it has not been expressly shown, the teaching of the present invention may be beneficially employed in antennas having a single arm.

Still further it may be beneficial to vary the location of the signal feed point, such as the illustrated alternative signal feed point 155. By varying the location of the feed point, it may be possible to associate a most proximate anticipated point of contact that is closer to the point where the signal source is applied to the particular arm, which can often produce beneficial results relative to the particular arm. In some instances, it may be still further desirable to position the feed point at the anticipated point of contact. However, by alternatively positioning the signal feed point at an anticipated most proximate point of contact for one of the arms, while you may be making the situation better for one of the arms, you may be making the situation worse for another arm. However, because the higher frequency shorter arms tend to be more problematic, the overall benefit of associating the feed point of the shorter arm closer to the anticipated most proximate point of contact may outweigh the detriment associated with an alternative arm of the antenna.

While in the illustrated embodiments, the interfering body has largely been associated with a user's body part, such as the hand, one skilled in the art will readily appreciate that other types of interfering bodies could similarly affect the performance of the antenna in a negative way. Generally, potentially interfering bodies include bodies incorporating conductive materials and/or materials having a high dielectric constant.

While the preferred and other embodiments of the invention have been illustrated and described, it will be clear that the invention is not so limited. Numerous modifications, changes, variations, substitutions, and equivalents will occur to those of ordinary skill in the art without departing from the spirit and scope of the present invention as defined by the following claims.

What is claimed is:

1. An antenna, located within an enclosure, said antenna including one or more arms, each arm having a length including a physical length corresponding to the distance along said arm between a feed point for receiving a signal source of a signal to be transmitted and an endpoint of the respective arm, and an electrical length corresponding to an intended frequency band of transmission, where at different points along said physical length of each of the arms of the antenna a source of external loading, separate from the signal source, has a variable effect, and where at different points along said physical length of each of the arms of the antenna, the antenna has a relatively high impedance area and a relatively low impedance area, wherein said enclosure includes one or more anticipated points of contact, where the source of external loading is brought into proximity with said enclosure, and wherein each of the one or more arms are constructed and arranged to locate the relatively high impedance areas along the physical length of a respective one of the one or more arms of the antenna at least a predetermined distance from the one or more anticipated points of contact, and the relatively low impedance areas along the physical length of the respective one of the one or more arms of the antenna are located more proximate the anticipated points of contact than the relatively high impedance area along the physical length of the respective one of the one or more arms of the antenna.

2. An antenna in accordance with claim 1, further including two or more arms, wherein a first one of the arms is associated with a relatively high frequency band of transmission, and a second one of the arms is associated with a relatively low frequency band of transmission.

3. An antenna in accordance with claim 1, wherein each arm extends from the feed point in a different direction relative to an internal contour of the enclosure.

4. An antenna in accordance with claim 1, wherein the feed point is positioned proximate one of the anticipated points of contact.

5. An antenna in accordance with claim 1, wherein each arm has an electrical length corresponding to a quarter of the wavelength of the intended frequency band of transmission.

6. An antenna in accordance with claim 5, wherein the endpoint of each arm is associated with a high impedance area.

7. An antenna in accordance with claim 1, wherein the antenna is a monopole antenna.

8. An antenna in accordance with claim 1, wherein the antenna is a dual frequency band antenna.

9. An antenna in accordance with claim 1, wherein a corresponding gap having a predetermined distance is maintained between the most proximate point of the antenna relative to each of the anticipated points of contact.

10. An antenna in accordance with claim 1, wherein the source of external loading includes an interfering body providing an electrically coupled source of impedance.

11. An antenna in accordance with claim 10, wherein the interfering body comprises one or more materials including one or more of a conductor, and a material having a high dielectric constant.

12. An antenna in accordance with claim 1, wherein the endpoints of at least two of the arms have an area of overlap.

13. An antenna in accordance with claim 12, wherein the area of overlap is located at least a predetermined distance from the one or more anticipated points of contact.

14. An antenna in accordance with claim 1, wherein said antenna is incorporated as part of a hand held wireless communication device.

15. An antenna in accordance with claim 1, wherein said wireless communication device is a cellular telephone.

16. An antenna in accordance with claim 14, wherein the hand held wireless communication device includes a housing having two parts, where the two parts of the housing are rotatably coupled together via a hinge; each of the two parts of the housing having a top edge and a bottom edge, where one of the two edges in each of the two parts of the housing is more proximate the position where the hinge is coupled; and wherein the antenna is located in one of the two housings of the wireless communication device proximate the other one of the two edges, which is less proximate the position where the hinge is coupled.

17. An antenna in accordance with claim 16, wherein one of the two parts of the housing is an upper housing and the other one of the two parts of the housing is a lower housing; where the upper housing is rotatably coupled to the lower housing via the hinge at the bottom edge of the upper housing, and the lower housing is rotatably coupled to the upper housing via the hinge at the top edge of the lower housing; and wherein the antenna is located proximate the bottom edge of the lower housing.

18. An antenna in accordance with claim 1, wherein a cross section of the antenna is substantially radially symmetrical.

* * * * *